US005447104A

United States Patent [19]

Lebet

[11] Patent Number: 5,447,104

[45] Date of Patent: Sep. 5, 1995

[54] METAL-CONTAINING, PRESS-FORMED EXPLOSIVE BODIES

[75] Inventor: Francis Lebet, Jorg Mathieu, both of Uetendorf, Switzerland

[73] Assignee: Schweizerische Eidgenossenschaft Vertreten Durch Die Eidg. Munitionsfabrik Thun Der Gruppe Fur Rustungsdienste, Thun, Switzerland

[21] Appl. No.: 143,444

[22] Filed: Oct. 26, 1993

[30] Foreign Application Priority Data

Dec. 28, 1992 [CH] Switzerland ..... 03955/92

[51] Int. Cl.[6] ..... C06D 5/06; C06B 21/00

[52] U.S. Cl. ..... 102/288; 102/287; 102/292; 269/3.1; 149/114

[58] Field of Search ..... 102/288, 289, 292; 149/114; 264/3.1

[56] References Cited

U.S. PATENT DOCUMENTS

| | | | |
|---|---|---|---|
| 2,647,047 | 7/1953 | Richardson | 149/114 X |
| 3,713,385 | 1/1973 | Lovecy | 102/28 R |
| 3,993,543 | 1/1976 | Madden | 149/114 X |
| 4,011,115 | 3/1977 | Harris et al. | 149/114 X |
| 4,187,129 | 2/1980 | Bost et al. | 149/114 X |
| 4,215,084 | 7/1980 | Maringer | 264/3.1 |
| 5,084,218 | 1/1992 | Vos et al. | 264/3.1 X |
| 5,388,518 | 2/1995 | Wong | 102/289 |

FOREIGN PATENT DOCUMENTS

| | | |
|---|---|---|
| 2031677 | 11/1970 | France . |
| 1078918 | 3/1960 | Germany . |
| 1105784 | 4/1961 | Germany . |
| 2053008 | 10/1970 | Germany . |
| 643804 | 6/1984 | Switzerland . |
| 973597 | 10/1964 | United Kingdom . |

*Primary Examiner*—Peter A. Nelson
*Attorney, Agent, or Firm*—Schweitzer Cornman & Gross

[57] ABSTRACT

A galvanically conductive explosive is formed by the admixture of a small proportion of precious metal-containing platelets to a binder. The resulting blend is combined with explosive granules to form a homogeneous mixture which, after press-forming, produces galvanically conductive bodies.

11 Claims, 2 Drawing Sheets

METAL-CONTAINING, PRESS-FORMED EXPLOSIVE BODIES

The present invention relates to a metal-containing, press-formed explosive body. The disclosure of Swiss Patent Application 03 955/92-9, filed Dec. 28, 1992, is incorporated herein by reference.

BACKGROUND OF THE INVENTION

It is known (CH A5-462688) to mix an ammonium nitrate explosive with mineral oil and a metal powder to reduce the sensitivity of the explosive with respect to electrostatic charges. Such explosives are often used in underground work and are commonly inserted into bore holes.

For mechanical reinforcement of cast or pressed explosives, metals in fiber form are used (U.S. Pat. No. 3,960,049), which also provide a certain conductivity. It is further known (FR A-2 003 626) that explosive charges made of nitrocellulose fibers may be heated by means of electrical conductors threaded through them to cause detonation. In all of these cases, only a relatively low specific conductance is achieved with no galvanic conduction.

It is thus an object of the invention to produce an electrically well-conducting explosive of high performance and handling safety. Such explosive, compared with other high-performance explosives, should have only a marginally lower detonation velocity. In addition, functioning of the explosive in a temperature range relevant for military uses of −35° C. to +63° C. must be ensured.

BRIEF DESCRIPTION OF INVENTION

The above-indicated task is fulfilled by the present invention in which is provided an electrically conductive explosive structure consisting of ductile precious-metal platelets, which platelets form galvanically conductive bridges around the explosive granules, having a conductance value of at least 5 S m/mm$^2$. The precious-metal platelets commercially available may be those known as "flakes" in metallurgy.

In the unpressed state, a mixture of explosive granules and "flakes" is not galvanically conductive. Surprisingly, however, during the processing process, the explosive granules become plated or clad and thus, even at a low precious-metal content, the combination forms a reliably acting, electrically-conductive structure.

An explosive according to the present invention permits the novel design of electrically detonated ammunition bodies which require no or few functionally-interfering electrical junction lines. Also, as a result of the metal cladding of the explosive granules, the handling safety of the system is enhanced.

A variety of platelets may be utilized, including those of silver and gold and alloys thereof.

The hardness value of the platelets should be chosen to ensure a sufficiently ductile behavior with commercially available explosive granules. Platelets of uniform size have been found to provide best results.

Although, as compared with nonconductive explosives, an explosive body according to the present invention may exhibit a slight reduction in performance, it is possible, especially on grounds of economic considerations, to combine it with further, conventional, high-performance explosives.

BRIEF DESCRIPTION OF THE DRAWINGS

In the following description, the invention is explained in greater detail with the aid of the annexed drawings, in which.

DETAILED DESCRIPTION OF THE INVENTION

A preferred embodiment of a galvanically conductive explosive body formed in accordance with the present invention utilizes a commercial explosive, such as Octogen, Class C of DYNO, Norway, commercial silver platelets, such as those known as "Silber-Flakes" of DORAL, Vetroz, Switzerland, and a commercial binder, such as DYNO's Octastir VIII L. Preferably, the weight proportion of the components are as follows:

86.7 wt.% explosive granules with a crystal density of 1.903 g/cm$^3$; 10.7 wt. % silver platelets having a diameter of 40 μm and a mean thickness of 0.4 μm; and 2.6 wt. % binder.

In a first step, the silver platelets and the binder are homogeneously mixed in a mixer, using agitation as known in the art. The binder, charged with the silver platelets, is then applied to the explosive granules in a drum mixer and the resultant blend dried. In this state, the mixture is not conductive. The explosive is then given its blank shape, using a per se known press mold in accordance with the known art. (comp. EP A1-0 296 099). The thus-produced body is galvanically conductive.

Figure 1:
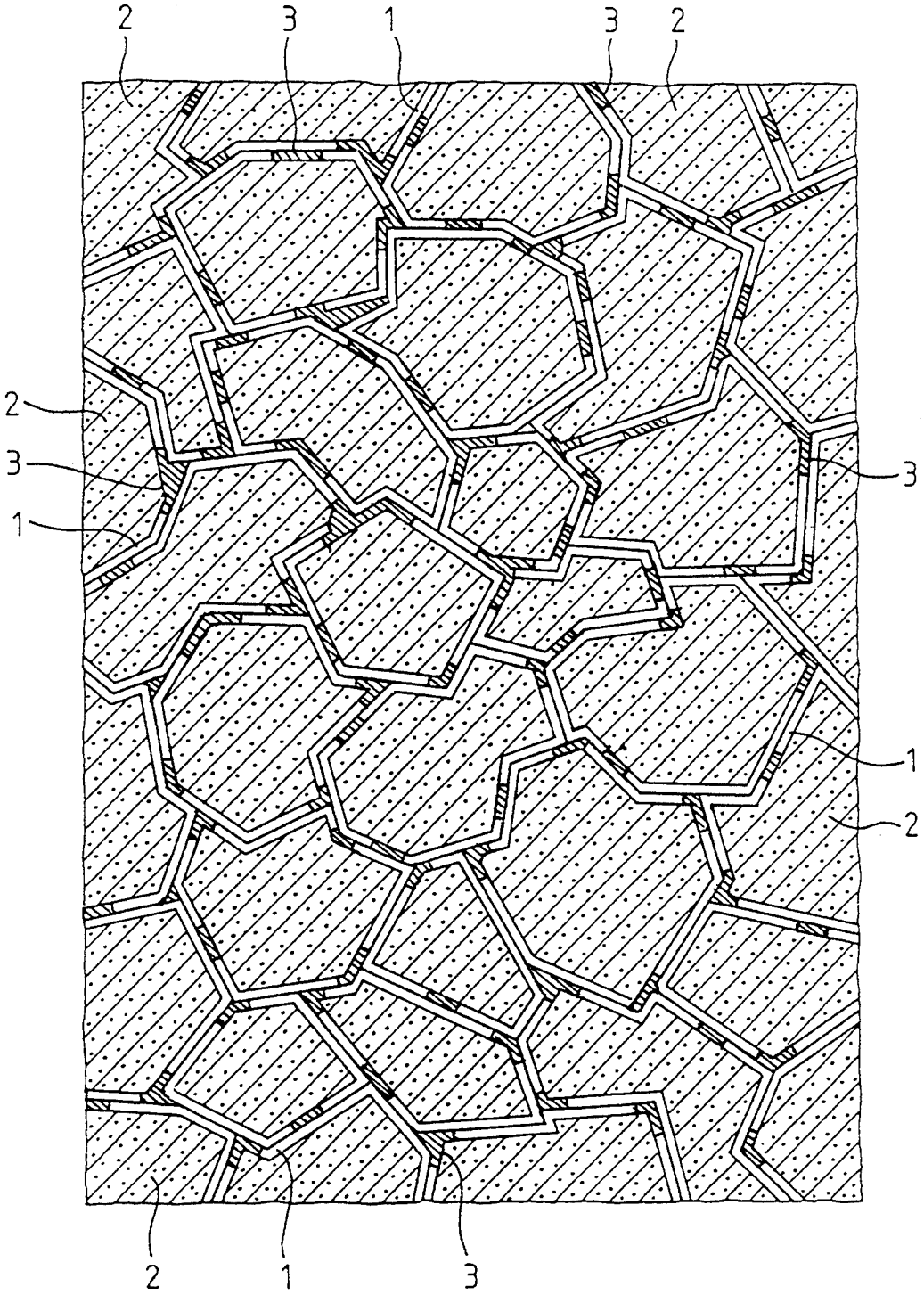
FIG. 1 is a schematic representation of the conductive structure in a galvanically conductive explosive body.

FIG. 1 is a representation of a scanning-microscope microphotograph depicting the resulting composition. Numeral 1 designates the precious-metal platelets, which substantially clad the explosive granules 2. The hollow spaces existing between the separate explosive granules 2 are partly filled with the binder 3.

Pressed cylindrical explosive compacts formed by the present process of a diameter of 21 mm and a length of 15 mm were tested. It was found that, with contact areas of 5 mm$^2$ and a distance between contacts of 10 mm, the passage resistance was less than 3 ohms. Detonation velocity exceeded 8370 m/sec. No significant differences in compressive strength could be determined relative to similar nonconductive bodies.

At a load of 8 kg, no effects were obtained in friction sensitivity as measured with a Peters instrument. At 10.8 crepitation set in. At a load of 12.0 kg, "burn" marks appeared.

Spark discharge sensitivity (measured with a GRD instrument) indicated that, at a spark energy of 18 mJ, no effects were discernible. At 56 mJ, very faint "burn" marks could be observed.

Impact sensitivity as determined by a drop-hammer test according to Koenen and IDE showed no effect at a drop height of 25 cm. At a drop height of 30 cm, "burn" marks were found.

DSC/TG-measurements (Differential Scanning Calorimetry/ Thermo-Gravimetry) of thermal stability yielded curves coinciding with those of nonconductive explosive, indicating that the addition of silver did not affect thermal decomposition.

A specific resistance of $3\times10^{-4}$ Ωcm, suitable for technical uses, was achieved with a silver proportion of 2% in the total volume. 1 volume-% silver resulted in a specific resistance of $10\times10^{-4}$ Ωcm, and 3 volume-% of silver yielded a specific resistance of $0.18\times10^{-4}$ Ωcm. Similar relationships obtained with other precious metals.

As an alternative composition, gold platelets may be used. In a preferred embodiment Class C Octogen is employed with commercial gold platelets (Gold-Flakes type Pn 3168 of Demetron, D-6450 Hanau, Germany) and Octastit VIII L binder.

80.2 wt. % explosive granules with a crystal density of 1.903 g/cm$^3$ may be used with 17.4 wt. % gold platelets having average diameter of 7.8 μm and a mean thickness of 0.4 μm, and with 2.4 wt. % binder. The charge is formed in the manner set forth above utilizing silver platelets. The resulting specific resistance is about 25% higher than of the respective silver sample as a result of a smaller platelet size. Therefore, for practical and economic reasons silver platelets may be preferred.

It has also been found that relatively soft precious metal alloys, such as silver alloys with a hardness up to 32 kg/mm$^2$ and gold alloys with a hardness of up to 20 kg mm$^2$ perform in a satisfactory manner. Platelets of various shapes can be employed. It has also been found that spherical or cylindrical platelets provide good results. The platelets should preferably be of a diameter of between 5 and 100 μm and with a thickness of 0.05 to 10 μm as appropriate. Relatively hard alloys such as, e.g., silver/copper alloys with 2 wt. % copper, and nonprecious metals in general were not suitable for use.

Figure 2:
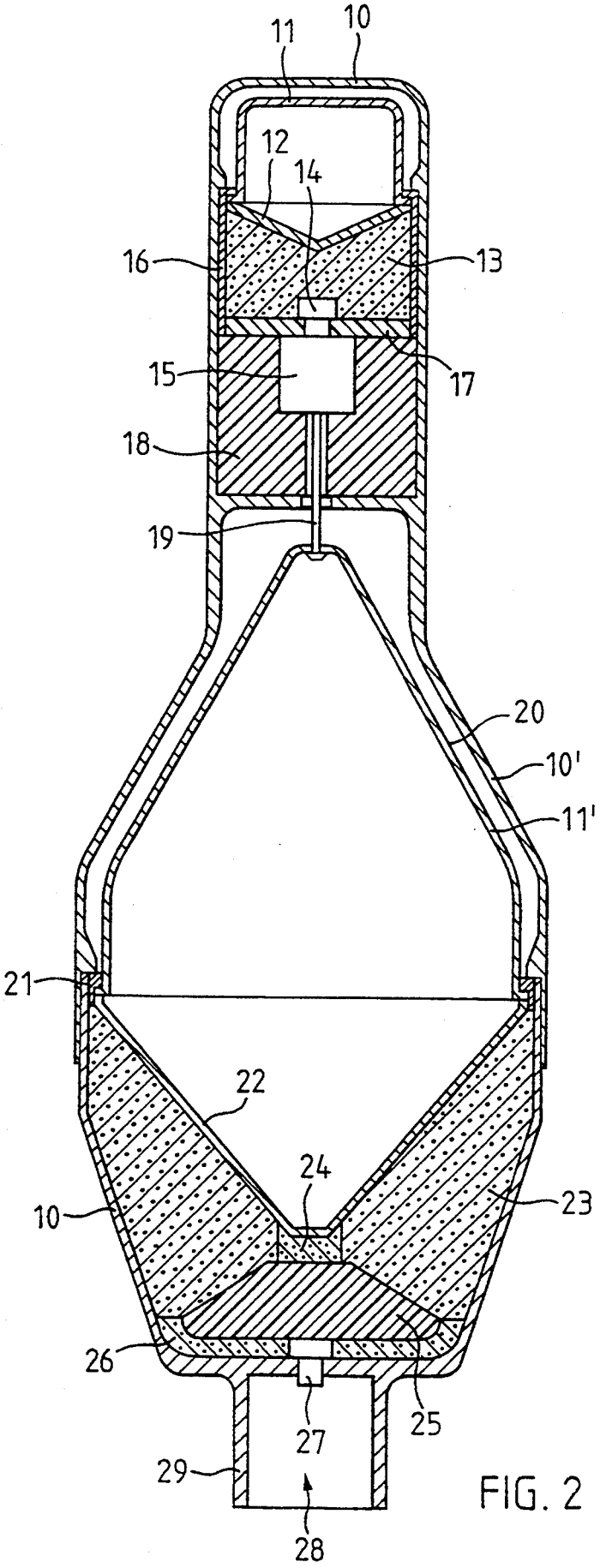
FIG. 2 is a representation of a tandem hollow charge with galvanically conductive explosive bodies of the present invention providing ignition signal transmission through the charge.

FIG. 2 represents a tandem hollow charge which uses galvanically conductive explosives of the present invention to eliminate electrical connections which would otherwise interfere with the hollow-charge jet. Use of the explosive of the present invention has also made it possible to simplify the structural design as compared with known designs.

The housing 10 is of a known double jacket construction. At the upper end, inner cap 11 is flanged to the housing and is separated therefrom by an intervening air gap. This double jacket serves, as known in the art, as a percussion conductor for initiation of the detonation signal.

An upper liner 12 is flanged onto electrically conductive explosive body 13, formed in accordance with the present invention, which acts as a front or top charge. A first fuse 14 is positioned at the bottom of the explosive body, opposite the double jacket, and is provided with a secondary charge 15, centrally held in position by an insulation washer 17.

A damping bushing 18, made of a plastic material, serves as shock insulation and is provided in the space below the explosive body 13 in a known manner. A second internal, cup-shaped part 20 is centered with the aid of a coupling flange 21 within the central portion of the housing, forming a second double jacket with housing portion 10' arranged in parallel to the first jacket. A lower conical liner 22 rests on main explosive charge 23. A further electrically conductive explosive body 24 is mounted on the cone frustum of the liner 22 and, by means of an electrical contact (not shown) is galvanically connected to a booster charge 27, centered in an inert lens 25. An additional lower charge 26 surrounds the end portion of the lens 25.

A conventional fuse 28 with ignition generator is mounted in the tail unit (not shown).

The general structural design, as well as the components used for the tandem charge, are known in the art. As a result of the incorporation of galvanically conductive explosive bodies of the present invention, the ammunition body is rendered more efficient, as the sensitive zones of the hollow-charge jets are not affected by interfering metal components or connecting leads.

The use of the present invention is not limited to military applications. Especially in safety engineering, it allows simple and compact electrical and electronic detonation circuits to be utilized. The conductance, better than that of graphite-containing explosives by a factor of $10^3$, ensures high functional safety of such designs.

We claim:

1. An electrically conductive press-formed explosive body, comprising explosive granules surrounded by precious metal platelets forming galvanically conductive bridges around the explosive granules, the explosive body having a conductance value of at least 5 S m/mm$^2$.

2. The explosive body as claimed in claim 1, wherein the precious metal is silver.

3. The explosive body as claimed in claim 1, wherein the precious metal is gold.

4. The explosive body as claimed in claim 1, wherein the platelets are of defined geometrical shapes and sizes.

5. The explosive body as claimed in claim 4, wherein the platelets are of spherical or cylindrical shape.

6. The explosive body as claimed in claim 5, wherein the platelets have a diameter of 5 μm to 100 μm, and a thickness of 0.05 μm to 10 μm.

7. The explosive body as claimed in claim 1, wherein the precious metal platelets comprise 1 to 3 percent of the volume of the explosive body constituents.

8. An electrically conductive press-formed explosive body, comprising explosive granules surrounded by low hardness precious metal alloy platelets forming galvanically conductive bridges around the explosive granules, the explosive body having a conductance of at least 5 S m/mm$^2$.

9. The explosive body as claimed in claim 8, wherein said alloy is an alloy of silver having a hardness of no more than 32 kg/mm $^2$.

10. The explosive body as claimed in claim 8, wherein said alloy is an alloy of gold having a hardness of no more than 20 kg/mm$^2$.

11. A method for preparing the explosive body as claimed in claim 1, comprising the steps of homogeneously mixing the precious metal-containing platelets and a binder in a first mixer; applying the binder to the explosive granules in a second mixer; drying the resulting mixture; and filling a press mold to form an explosive blank.

* * * * *